US006536687B1

(12) United States Patent
Navis et al.

(10) Patent No.: US 6,536,687 B1
(45) Date of Patent: Mar. 25, 2003

(54) MIXING CUP ADAPTING ASSEMBLY

(75) Inventors: Keith C. Navis, St. Paul, MN (US); David C. Roeker, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/374,794

(22) Filed: Aug. 16, 1999

(51) Int. Cl.[7] ..... B05B 7/30

(52) U.S. Cl. ..... 239/345; 239/350; 239/318; 239/341; 239/378; 141/383; 141/346; 222/482; 222/189.06; 222/158

(58) Field of Search ..... 239/345, 340, 239/337, 347, 350, 318, 378; 222/189.06, 481, 158, 482; 141/383, 346, 385, 384

(56) References Cited

U.S. PATENT DOCUMENTS 856,361 A * 6/1907 Neiburg
1,476,668 A * 12/1923 Agnew, Sr.
2,263,843 A * 11/1941 Gross
2,770,706 A * 11/1956 Vogtle et al.
4,773,569 A * 9/1988 Larsson
4,811,904 A * 3/1989 Ihmels et al.
4,946,075 A * 8/1990 Lundback
5,069,389 A * 12/1991 Bitsakos
5,271,683 A * 12/1993 Snetting et al.
5,601,212 A * 2/1997 Lee
5,803,367 A * 9/1998 Heard et al.
6,165,159 A * 12/2000 Blanton

FOREIGN PATENT DOCUMENTS

CH 653-574 A * 1/1986
DE 2412743 A * 1/1975
WO WO 98/32539 7/1998

* cited by examiner

*Primary Examiner*—Christopher Kim

(57) ABSTRACT

An assembly for feeding liquid to the inlet port of a gravity feed sprayer. The assembly includes (1) a mixing cup of a known type commonly used to mix paint with solvent that is of stiff polymeric material and bears indicia on its side wall indicating the levels to which a plurality of different liquids should be sequentially poured into the cup to achieve a predetermined ratio between the liquids; (2) a first adapter comprising a central portion having a through opening and a transverse portion including a peripheral part defining a groove along its inner surface adapted for sealing engagement.with a top end of the mixing cup; and (3) a second adapter having a through opening, a first end portion of which second adapter is adapted to releasably engage the inlet port of a gravity feed paint sprayer. A second end portion of the second adapter and the central portion of the first adapter have connector parts adapted for releasable liquid tight engagement between the adapters with their through openings in communication.

11 Claims, 4 Drawing Sheets

MIXING CUP ADAPTING ASSEMBLY

FIELD OF THE INVENTION

The present invention relates to the liquid supply assemblies for gravity fed liquid (e.g., paint) spraying devices or spray guns.

BACKGROUND OF THE INVENTION

Various liquid supply assemblies have been described for use with gravity fed liquid (e.g., paint) spraying devices or spray guns, including those described in the international application published as International Publication Number WO 98/32539 on Jul. 30, 1998, the content whereof is incorporated herein by reference. The supply assembly including a collapsible liner that is described and claimed in that application should provide advantages over the prior art liquid supply assembly also described in that application.

DISCLOSURE OF THE INVENTION

The present invention provides a liquid supply assembly for use with gravity fed liquid spraying devices that, like the liquid supply assembly described and claimed in WO 98/32539, should also provide advantages over the prior art liquid supply assembly described in that application.

According to the present invention there is provided a liquid supply assembly adapted for use on a gravity fed liquid spraying device that comprises (1) a mixing cup of stiff polymeric material that bears indicia on its side wall indicating the levels to which a plurality of different liquids should be sequentially poured into the cup to achieve a predetermined ratio between the liquids; (2) a first adapter comprising a central portion having a through opening and a transverse portion including a peripheral part defining a groove along its inner surface adapted for sealing engagement with a top end of the mixing cup; (3) a second adapter having a through opening, a first end portion adapted to releasably engage the inlet port of the spraying device; and a second end portion having a connector part adapted for releasable liquid tight engagement with a connector part on the central portion of the first adapter with the through openings in communication.

The mixing cup is of a known type commonly used in paint shops to mix different paints and/or to mix paint with solvent. Those liquids are mixed using indicia on the side walls of the mixing cup. That indicia indicates the levels to which two or three different liquids should be sequentially poured into the mixing cup to provide a predetermined ratio between those liquids, such indicia being provided for a plurality of different ratios. Prior to this invention, liquid from the mixing cup was poured into a liquid supply assembly for a spray gun, and if liquid remained after the spraying operation was complete, that remaining liquid was sometimes poured back into the mixing cup, an air tight cover was applied thereto, and the liquid (e.g., paint) was stored for future use in the covered mixing cup.

The present invention affords further use of that mixing cup as part of the liquid supply assembly for the spraying device. This eliminates the need to pour the mixed liquid (e.g., paint) out of the mixing cup prior to spraying, or to pour unsprayed liquid back into the mixing cup after the spraying operation. Instead, the liquid is mixed in the mixing cup, remains in the mixing cup during the spraying operation when the mixing cup becomes part of the liquid supply assembly for the spraying device, and if unsprayed liquid remains after the spraying operation, it can be retained in the mixing cup which is then separated from the rest of the liquid supply assembly and can have a conventional air tight cover applied to it for storage.

A vacuum relief for the liquid supply assembly can be provided by inserting a tapered removable pin (e.g., a pin of the type sometimes called a "push pin") through the side wall of the mixing cup adjacent its bottom wall. That pin is removed during use of the mixing cup in the liquid supply assembly for the spraying device when the mixing cup is positioned with its bottom wall uppermost so that air can enter the cup through an air passageway formed by the pin above the liquid being supplied to the spraying device. Before and after the spraying operation when the cup is supported on its bottom wall that pin may be positioned in the passageway it forms to preclude liquid leaking out of the mixing cup through that passageway.

The liquid supply assembly can also include a removable filter assembly for filtering liquid leaving the mixing cup during the spraying operation.

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 5:
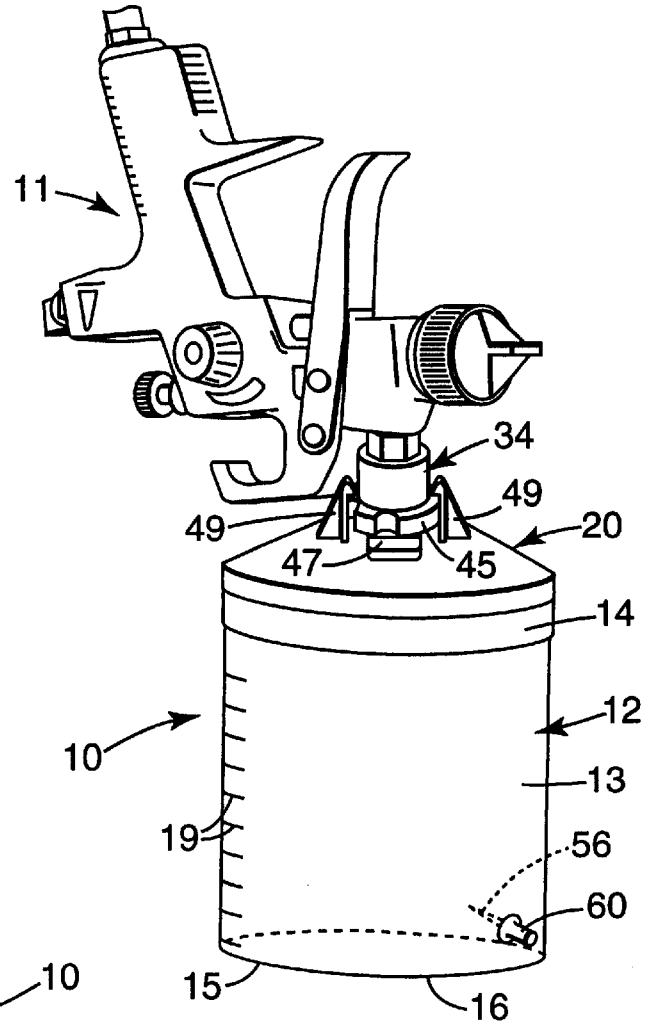
FIG. 5 is a perspective view of the liquid supply assembly of FIG. 1 attached to an inverted spraying device or spray gun.
Figure 6:
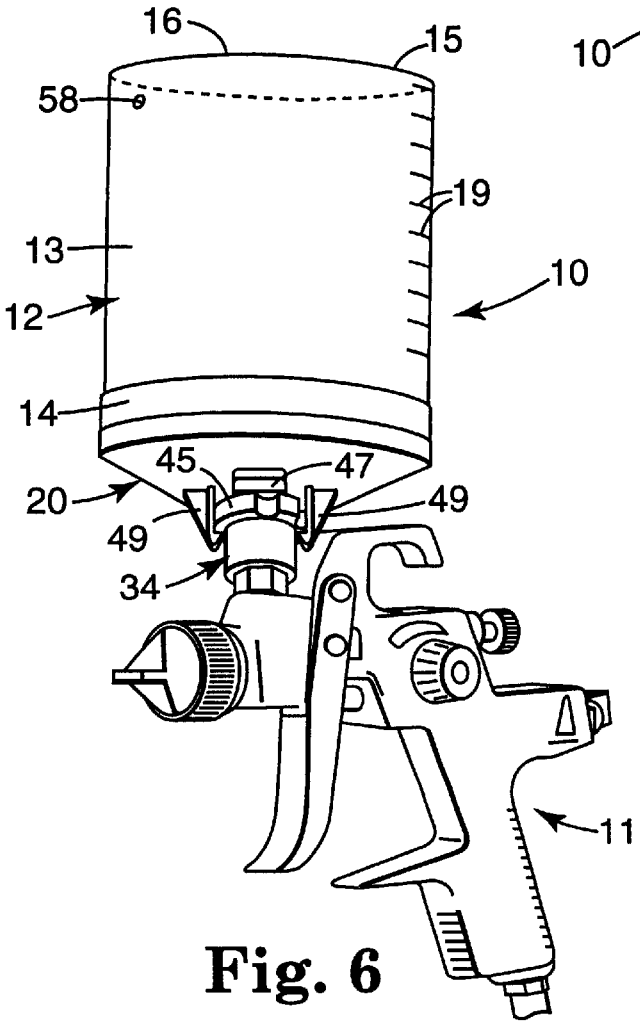
FIG. 6 is a perspective view of the liquid supply assembly of FIG. 1 attached to the spraying device as in FIG. 5 and inverted to the position used for spraying liquid with the spraying device.

Referring now to the drawing there is illustrated a liquid supply assembly according to the present invention generally designated by the reference numeral 10. That liquid supply assembly 10 (as is illustrated in FIGS. 3, 5 and 6) can be used to supply liquid for a conventional gravity fed liquid spraying device or spray gun 11 (e.g., the spray gun commercially designated NR 95 that is available from Sata, Farbspritzechnik GmbH & Co., Kornwestheim, Germany.

Figure 1:
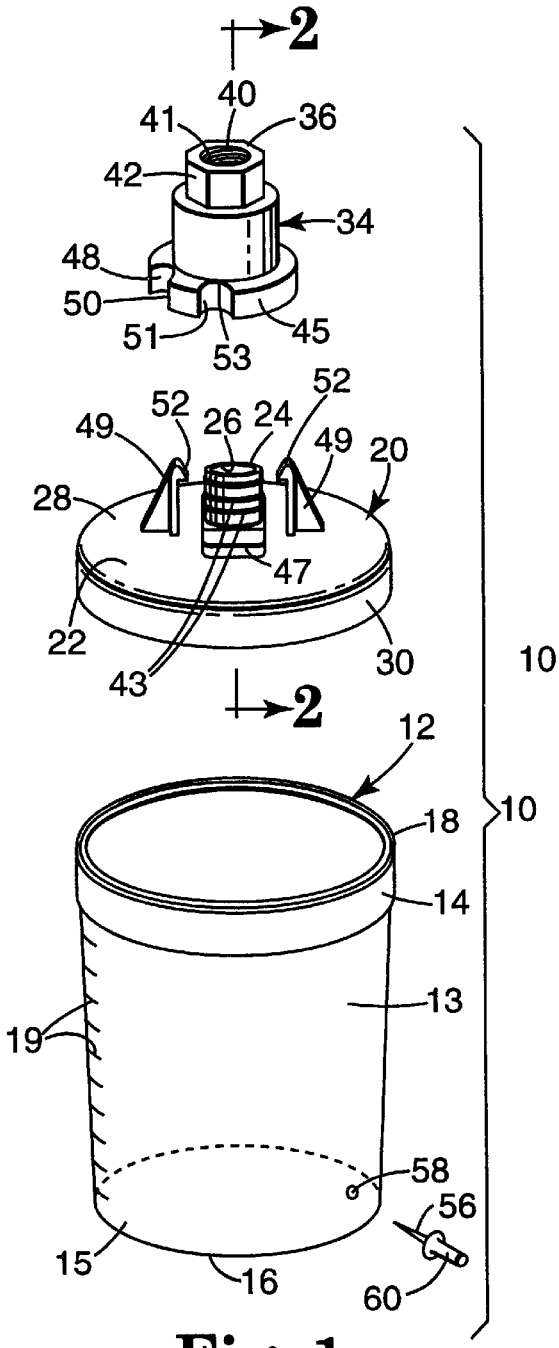
FIG. 1 is an exploded perspective view of a liquid supply assembly according to the present invention.
Figure 3:
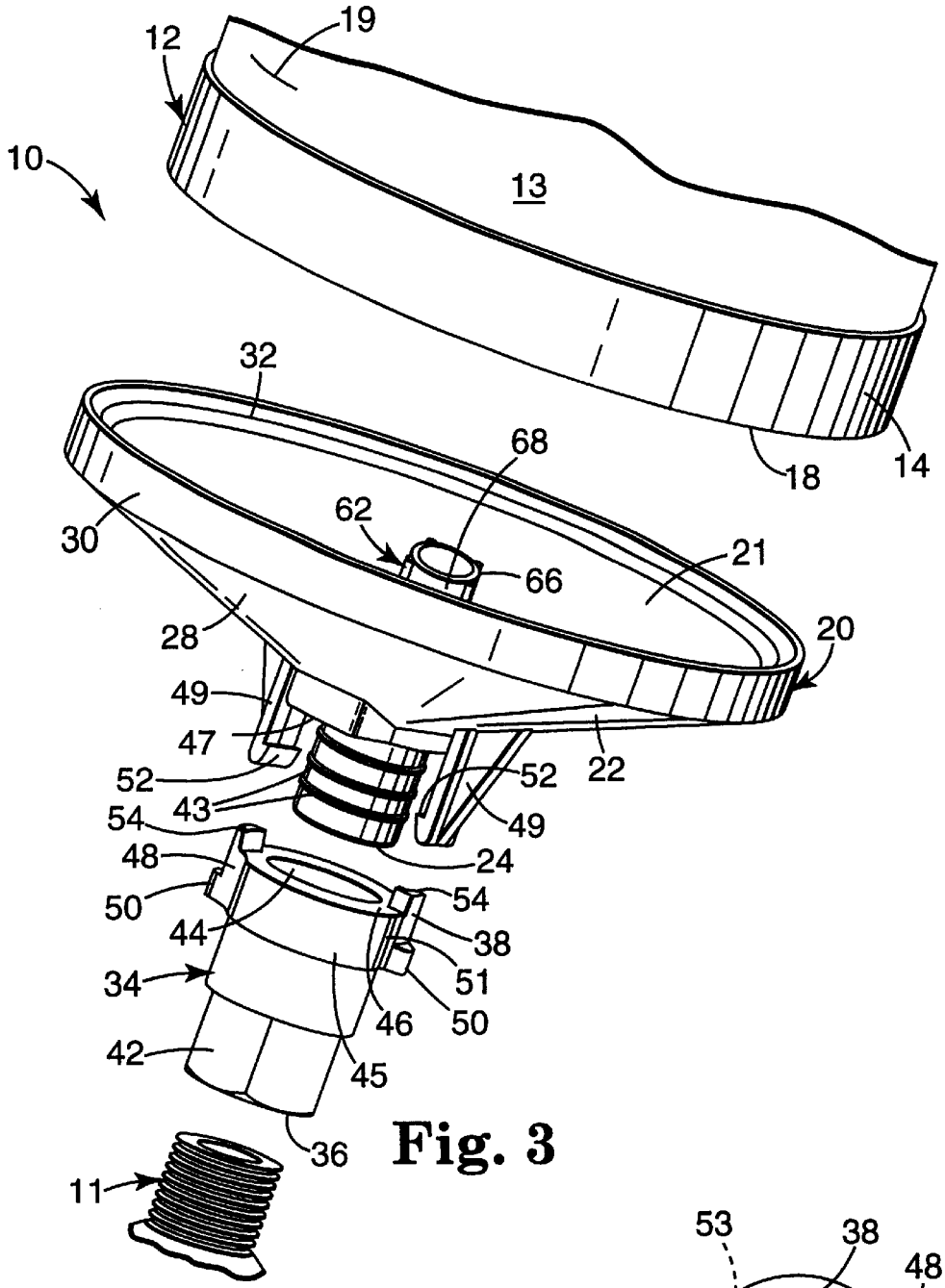
FIG. 3 is an enlarged exploded perspective view of the liquid supply assembly of FIG. 1 together with a fragment of a spraying device or spray gun to which the liquid supply assembly is adapted to be attached.

As is best seen in FIGS. 1 and 3, the liquid supply assembly 10 includes a conventional paint mixing cup 12 of stiff polymeric material (e.g., the polyethylene mixing cups commercially available from PPG, Cleveland, Ohio, which can be obtained in 8 ounce or 240 ml, or 16 ounce or 480 ml, or 24 ounce or 720 ml, or 32 ounce or 960 ml sizes). The paint mixing cup comprises a generally cylindrical side wall 13 having top and bottom ends 14 and 15, a bottom wall 16 extending across and closing the bottom end 15 of the side wall 13, and an outwardly projecting lip 18 around the top end 14 of the side wall 13. The top end 14 of the side wall 13 defines an opening into the cup 12. The side wall 13 bears indicia 19 indicating the levels to which two or three different liquids should be sequentially poured into the cup 12 through that opening to provide a predetermined ratio between those liquids, that indicia 19 being provided for a plurality of different ratios. The side wall 13 is sufficiently translucent to afford seeing the liquid level in the cup 12 through the side wall 13 which assists a person in adding liquids to the desired levels indicated by the indicia 19.

Figure 2:
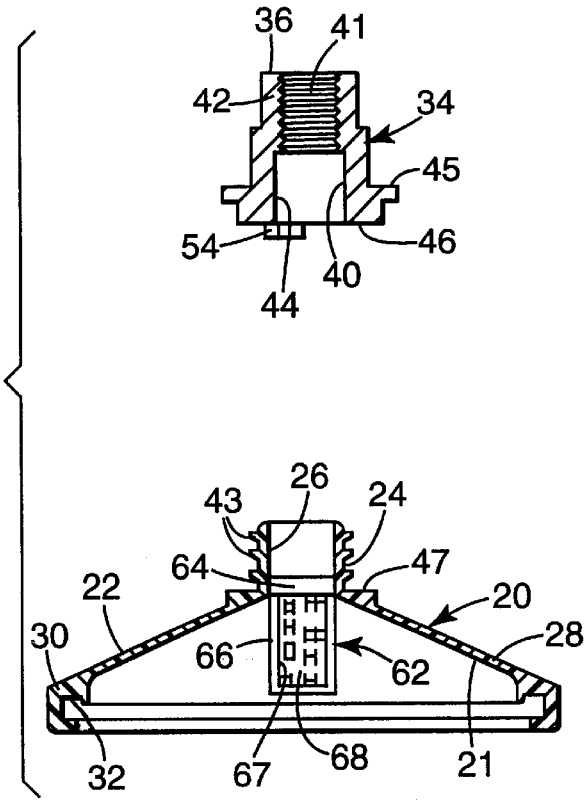
FIG. 2 is an enlarged sectional view taken approximately along section line 2—2 of FIG. 1.

The liquid supply assembly 10 also includes a first adapter 20, (see FIGS. 1, 2, and 3) preferably molded of polymeric material (e.g., polyethylene), having opposite inner and outer major surfaces 21 and 22. The first adapter 20 comprises a central generally cylindrical portion 24 having a through opening 26 and a transverse portion 28 including a peripheral part 30. The transverse portion 28 defines a groove 32 along its inner surface that is adapted for sealing engagement with the top end 14 and outwardly projecting lip 18 of the paint mixing cup 12.

A second adapter 34 (see FIGS. 1, 2, 3, and 4), also included in the liquid supply assembly 10, is preferably of metal (e.g., aluminum), has first and second spaced end portions 36 and 38, and has a through opening 40 extending through those end portions 36 and 38. The first end portion 36 of the second adapter 34 has internal threads 41 and six flatted wrench engageable surface portions 42 around its periphery, thereby being adapted to be releasably engaged with external threads on the inlet port of the gravity feed spray gun 11. The first adapter 20 and the second end portion 38 of the second adapter 34 have connector parts that are adapted for releasable liquid tight engagement with their through openings 26 and 40 in communication. Those connector parts include axially spaced radially outwardly projecting sealing rings 43 along the outer surface of the cylindrical portion 24, and a cylindrical inner surface 44 of the second adapter 34 that defines a cylindrical bore opening through the end of the second adapter 34 opposite the threads 41.

That bore is adapted to receive the cylindrical portion 24 of the of the first adapter 20 in an engaged position with the sealing rings 43 in slightly compressed liquid tight engagement with the inner surface 44 defining the bore and with an end surface 46 on a collar 45 around the second end portion 38 of the second adapter 34 abutting a boss 47 in the first adapter 20 around the cylindrical portion 24. The collar 45 has major cylindrically concave recesses 48 along opposite sides of its periphery (see "Figure 4) adapted to pass the distal ends of hook members 49 projecting from the transverse portion 28 of the first adapter 20 on opposite sides of the cylindrical portion 24 when the cylindrical portion 24 is pressed axially into the bore with the first and second adapters 20 and 34 in a first relative position at which the hook members 49 are aligned with the major recesses 48 in the collar 45. The first and second adapters 20 and 34 can then be rotated relative to each other to a second relative position to cause the resiliently flexible projecting hook members 49 to be deflected outwardly by, and to move around, cylindrically convex cam lobes 50 projecting radially outwardly on corresponding sides of the major recesses 48 until the projecting hook members 49 are positioned in minor cylindrically concave recesses 51 in the collar 45 at which opposed inwardly projecting lips 52 on the distal ends of the projecting hook members 49 are engaged over a surface 53 of the collar 45 adjacent the first end 36 of the second adapter 34. Lugs 54 projecting axially past the end surface 46 of the collar 45 are adapted to move between positions engaging sides of the boss 47 on the first adapter 20 when the cylindrical portion 24 is in its engaged position in the bore defined by the inner surface 44, thereby limiting relative movement between the adapters 20 and 34 to movement to and between those first and second relative positions.

The liquid supply assembly 10 further includes a tapered, pointed, removable pin 56 (e.g., a pin of the type sometimes called a "push pin") extending through a passageway 58 in the side wall 13 of the cup 12 adjacent its bottom wall 16 (see FIGS. 1 and 5). On the end of the pin 56 opposite its point is a molded head 60 by which the pin 56 can be manually pressed through the side wall 13 to form the passageway 58. When the cup 12 is inverted to supply liquid to the spray gun 11 as is illustrated in FIG. 6, the pin 56 can be removed so that the passageway 58 will provide vacuum relief for the cup 12 by then allowing air to enter the cup 12 through the passageway 58 above the liquid (e.g., paint) being supplied to the spray gun 11. Before and after any such spraying operations that pin 56 may be positioned in the passageway 58 as is illustrated in FIG. 5 to preclude liquid within the cup 12 from leaking through the passageway 58 when the cup is supported on its bottom wall 16.

The combination 10 can also include a removable-filter assembly 62 (see FIGS. 2 and 3) of a known commercially available type (e.g., the filter commercially designated "paint filter kit" that is commercially available from Standard Color, St. Paul, Minn.). The filter assembly 62 includes a stiff polymeric frame comprising a cylindrical outlet portion 64 having a cylindrical outer surface frictionally engaged within the inner surface defining the through opening 26 in the central portion 24, which outlet portion 64 has a through opening. The frame of the filter assembly 62 further includes an inlet portion 66 projecting from the inner surface 21 of the transverse portion 28 of the first adapter 20. The inlet portion 66 has four axially extending rectangular inlet passageways 67 spaced around its periphery that communicate with the through opening in the outlet portion 64, and includes a filter screen 68 extending across the inner ends of those inlet passageways 67.

Figure 4:
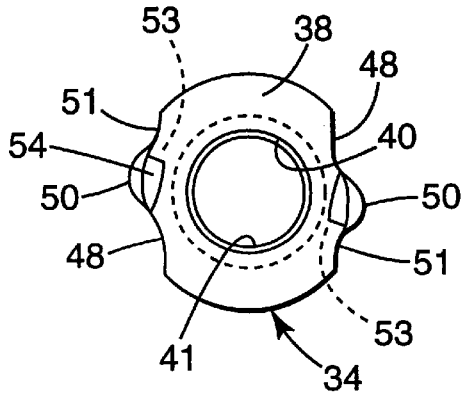
FIG. 4 is an end view of a second adapter included in the liquid supply assembly of FIG. 1.
Figure 7:
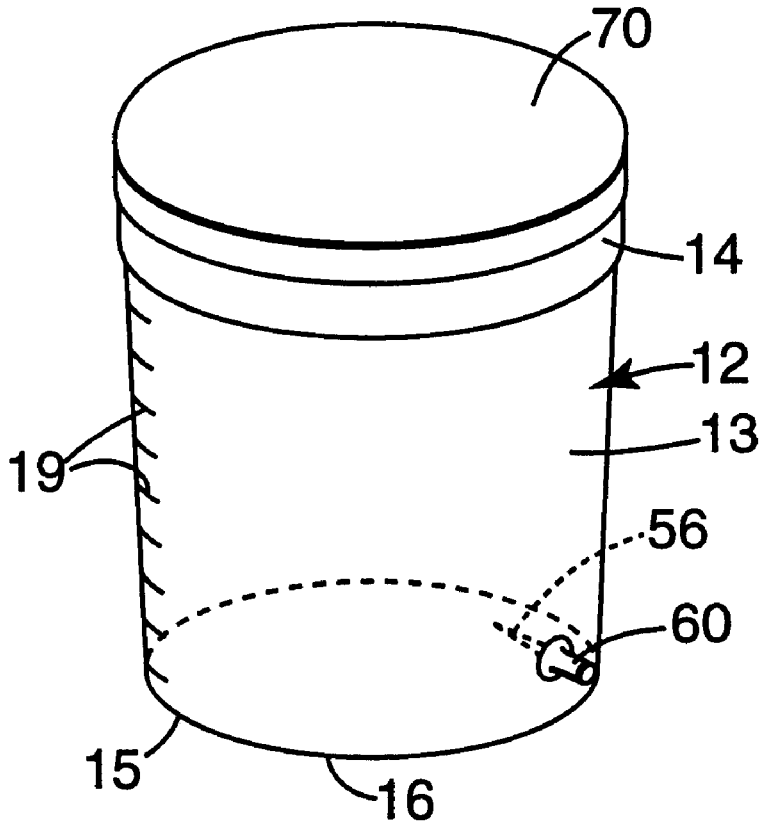
FIG. 7 is a perspective view of a mixing cup included in the liquid supply assembly of FIG. 1, which mixing cup has been separated from the rest of the liquid supply assembly and has had a conventional cover applied to it.

A method according to the present invention for providing a supply of mixed liquids for the gravity fed liquid spraying device 11 includes mixing the liquids in the mixing cup 12 using the indicia 19 to indicate the levels to which the liquids should be sequentially poured into the cup 12 to achieve the desired ratio between the liquids; engaging the peripheral part 30 of the first adapter 20 with the top end 14 of the mixing cup 12 containing the mixed liquids; engaging the first end 36 of the second adapter 34 with the inlet port of the liquid spraying device 11 (if this has not already been done); engaging the connector parts as described above (this being done with the mixing cup supported on its bottom wall and the spraying device inverted as illustrated in FIG. 3); and positioning the spraying device 11 as illustrated in FIG. 4 so that the bottom wall 16 of the mixing cup 12 is uppermost to feed the liquid in the mixing cup 12 to the spraying device 11 through the filter assembly 62 and the openings 26 and 40 in the adapters 20 and 34. That method can further include inserting the tapered pin 56 through the side wall 13 of the mixing cup 12 adjacent its bottom wall 16, and removing the tapered pin 56 from the side wall 13 after the spraying device 11 is positioned with the bottom wall 16 of the mixing cup 12 uppermost as illustrated in FIG. 4 to feed the liquid in the mixing cup 12 to the spraying device. Such insertion of the tapered pin 56 provides the passageway 58 through the side wall 13 of the mixing cup 12 adjacent its bottom wall 16 so that air can flow into the cup 12 through the passageway 58 as the liquid is sprayed to restrict causing a vacuum in the mixing cup 12. If liquid remains in the mixing cup 12 after use of the liquid spraying device 11, the pin 56 can be inserted through the passageway 58 to restrict leakage of liquid through the passageway 58; the spraying device 11 can again be inverted to the position illustrated in FIG. 3, the connector parts can be disconnected, the first adapter 20 can be removed from the top end 14 of the mixing cup 12 containing the remaining liquid; a conventional cover 70 (see FIG. 7) can be applied to the top end 14 of the mixing cup 12, and the remaining liquid can be stored for future use in the covered mixing cup 12. The inexpensive first adapter 20 and the filter assembly 52 can then be disposed of so that cleanup of the liquid supply assembly 10 only requires cleaning the second adapter 34, which is cleaned with the spray gun 11.

The present invention has now been described with reference to one embodiment thereof. It will be apparent to those skilled in the art that many changes can be made in the embodiment described without departing from the scope of the present invention. For example, any of a number of different types of connectors can be used between the adapters 20 and 34. Thus, the scope of the present invention should not be limited to the structures and methods described in this application, but only by the structures and methods described by the language of the claims and the equivalents thereof.

What is claimed is:

1. A liquid supply assembly for use on a gravity fed liquid spraying device, said supply assembly comprising:

a mixing cup of stiff polymeric material comprising a side wall having top and bottom ends, and a generally planer bottom wall extending across and closing the bottom end of said side wall, said top end of said side wall defining an opening into said cup, and said side wall bearing indicia indicating the levels to which a plurality of different liquids can be sequentially poured into the cup to achieve a predetermined ratio between the liquids;

a first adapter of polymeric material having an inner major surface and an opposite outer major surface, said first adapter comprising a central portion having a through opening and a transverse portion including a peripheral part defining a groove along said inner major surface receiving said top end of said mixing cup in sealing engagemnent with said peripheral part; and a second adapter having a first end portion and a second end portion spaced from said first end portion, said second adapter having a through opening extending through said first and second end portions, said first end portion being adapted to releasably engage an inlet port of the gravity fed liquid spraying device;

said second end portion of said second adapter and said central portion of said first adapter having connector parts in manually releasable liquid tight engagement between said adapters with said through openings in communication; and said assembly further including a tapered, pointed, push pin extending through said side wall of said mixing cup adjacent said bottom wall, said push pin having been pressed through the side wall to form a passageway through the sidewall, being positioned in the passageway to restrict any liquid in the mixing cup from moving through the passageway, being removable from the passageway to allow air to move through the passageway into the mixing cup adjacent said bottom wall, and after such removal being again positionable in the passageway to restrict any liquid in the mixing cup from moving through the passageway.

2. An assembly according to claim 2 further including a removable filter assembly including a frame comprising-an outlet portion engaged across said through opening in said central portion and having a through opening, said frame further including an inlet portion projecting from the inner surface of said first adapter and having inlet passageways communicating with said through opening in said outlet portion, and a filter screen extending across said inlet passageways.

3. Adapters for using a mixing cup of stiff polymeric material as part of a liquid supply assembly for a gravity fed liquid spraying device, said mixing cup comprising a side wall having top and bottom ends, and a generally planer bottom wall extending across and closing the bottom end of said side wall, said top end of said side wall defining an opening into said cup, and said side wall bearing indicia indicating the levels to which a plurality of different liquids can be sequentially poured into the cup to achieve a predetermined ratio between the liquids; said adapters comprising a first adapter having an inner major surface and an opposite outer major surface, said first adapter comprising a central portion having a through opening and a transverse portion including a peripheral part defining a groove along said inner major surface adapted to receive said top end of said mixing cup in sealing engagement with said peripheral part; and a second adapter having a first end portion and a second end portion spaced from said first end portion, said second adapter having a through opening extending through said first and second end portions, said first end portion being adapted to engage an inlet port of the gravity fed liquid spraying device;

said second end portion of said second adapter and said central portion of said first adapter having connector parts in manually releasable liquid tight engagement between said adapters with said through openings in communication; and said adapters further including a tapered, pointed, removable push pin pressed through said side wall of said mixing cup adjacent said bottom wall to form a passageway through the sidewall and being positioned in the passageway to restrict any liquid in the mixing cup from moving through the passageway, which push pin can be removed from the passageway to allow air to move through the passageway into the mixing cup adjacent said bottom wall, and after such removal can again be positioned in the passageway to restrict any liquid in the mixing cup from moving through the passageway.

4. Adapters according to claim 3 wherein said first adapter is of polymeric material.

5. Adapters according to claim 3 further including a removable filter assembly including a frame comprising an outlet portion engaged across said through opening in said central portion and having a through opening, said frame further including an inlet portion projecting from the inner surface of said first adapter and having inlet passageways communicating with said through opening in said outlet portion, and a filter screen extending across said inlet passageways.

6. A method for providing a supply of mixed liquids for a gravity fed liquid spraying device, said method comprising the steps of:

providing a mixing cup of stiff polymeric material comprising a side wall having top and bottom ends, and a bottom wall extending across and closing the bottom end of said side wall, said top end of said side wall defining an opening into said cup, and said side wall bearing indicia indicating the levels to which the liquids can be sequentially poured into the cup to achieve a predetermined ratio between the liquids;

providing adapters including a first adapter having an inner major surface and an opposite outer major surface, said first adapter comprising a central portion having a through opening and a transverse portion including a peripheral part defining a groove along said inner major surface adapted to receive the top end of said mixing cup in sealing engagement with said peripheral part, and a second adapter having a first end portion and a second end portion spaced from said first end portion, said second adapter having a through opening extending through said first and second end portions, said first end portion being adapted to engage an inlet port of the gravity fed liquid spraying device; said second end portion of said second adapter and said central portion of said first adapter having connector parts adapted for manually releasable liquid tight engagement between said adapters with said through openings in communication;

mixing the liquids in the mixing cup using the indicia to indicating the levels to which the liquids are poured into the cup to achieve a predetermined ratio between the liquids;

engaging the first adapter with the top end of the side wall of the mixing cup containing the mixed liquids;

inserting a tapered pin through the side wall of the mixing cup adjacent said bottom wall to form a passageway through the sidewall, said pin being positioned in the passageway to restrict any liquid in the mixing cup from moving through the passageway;

engaging the first end portion of the second adapter with an inlet port of the gravity fed liquid spraying device;

manually engaging the connector parts;

positioning the spraying device so that the bottom wall of the mixing cup is uppermost to feed the liquid in the mixing cup to the spraying device through the openings in the adapters; and removing the tapered pin from the side wall during the positioning step to allow air to move through the passageway into the mixing cup adjacent said bottom wall.

7. A method according to claim 6 further including the steps, used when liquid remains in the mixing cup after use of the liquid spraying device, of manually separating the connector parts to separate the adapters, removing the first adapter from the top end of the mixing cup containing the remaining liquid; applying a cover to the top end of the mixing cup, and storing the remaining liquid in the covered mixing cup.

8. A method according to claim 7 further including the step of reinserting the pin through the passageway to restrict leakage of liquid through the passageway during the steps of removing the first adapter, applying the cover, and storing the covered mixing cup.

9. A method according to claim 6 wherein said first adapter is of polymeric material and said method further includes the step of manually separating the connector parts to separate the adapters, removing the first adapter from the top end of the mixing cup, and disposing of the first adapter.

10. A method according to claim 6 wherein said first adapter is of polymeric material and said method further includes the steps, used when liquid remains in the mixing cup after use of the liquid spraying device, of manually separating the connector parts to separate the adapters, removing the first adapter from the top end of the mixing cup containing the remaining liquid; disposing of the first adapter, applying a cover to the top end of the mixing cup, and storing the remaining liquid in the covered mixing cup.

11. A liquid supply assembly for use on a gravity fed liquid spraying device, said supply assembly comprising:

a mixing cup of stiff polymeric material comprising a side wall having top and bottom ends, and a generally planer bottom wall extending across and closing the bottom end of said side wall, said top end of said side wall defining an opening into said cup, and said side wall bearing indicia indicating the levels to which a plurality of different liquids can be sequentially poured into the cup to achieve a predetermined ratio between the liquids;

an adapter assembly having an inner major surface and an opposite outer major surface, said adapter assembly comprising a transverse portion including a peripheral part defining a groove along said inner major surface receiving said top end of said mixing cup in sealing engagement with said peripheral part, and a first end portion opposite said transverse portion adapted to releasably engage an inlet port of the gravity fed liquid spraying device, said inner surface defining a through opening extending through said transverse portion and said first end portion;

said assembly further including a tapered, pointed, removable push pin extending through said side wall of said mixing cup adjacent said bottom wall, said push pin having been pressed through the side wall to form a passageway through the side wall, being positioned in the passageway to restrict any liquid in the mixing clip from moving through the passageway, being removable from the passageway to allow air to move through the passageway into the mixing cup adjacent said bottom wall, and after such removal being again positionable in the passageway to again restrict any liquid in the mixing cup from moving through the passageway.

* * * * *

UNITED STATES PATENT AND TRADEMARK OFFICE

CERTIFICATE OF CORRECTION

PATENT NO. : 6,536,687 B1
DATED : March 25, 2003
INVENTOR(S) : Keith C. Navis

It is certified that error appears in the above-identified patent and that said Letters Patent is hereby corrected as shown below:

Title page,
Item [75], Inventors, delete "Keith C. Navis, St. Paul, MN; David C. Rocker, St. Paul, MN" and insert in place thereof -- Keith C. Navis, White Bear Lake, MN; David C. Rocker, Hudson, WI --.
Item [56], References Cited, U.S. PATENT DOCUMENTS, please add:

| | | |
|---|---|---|
| -- 2,612,404 | 09/1952 | Anderson |
| 2,901,182 | 08/1959 | Cragg et al. |
| 4,411,387 | 10/1983 | Stern et al. |
| 4,993,639 | 02/1991 | Hata -- |

Column 6,
Line 8, delete "claim 2" and insert in place thereof -- claim 1 --.

Column 8,
Line 50, delete "clip" and insert in place thereof -- cup --.

Signed and Sealed this

Twenty-seventh Day of January, 2004

JON W. DUDAS
*Acting Director of the United States Patent and Trademark Office*